United States Patent [19]

Winkler et al.

[11] 4,056,209

[45] Nov. 1, 1977

[54] MEDICATION BOTTLE HAVING A SAFETY CAP

[75] Inventors: Robert J. Winkler, Santa Ana; Clarence R. Possell, San Diego, both of Calif.

[73] Assignee: W.P. Energy Technology Systems, Santa Ana, Calif.

[21] Appl. No.: 780,511

[22] Filed: Mar. 23, 1977

[51] Int. Cl.[2] ..... B65D 55/02; B65D 85/56; A61J 1/00

[52] U.S. Cl. ..... 215/215; 215/296; 215/302; 206/1.5

[58] Field of Search ..... 215/215, 296, 302, 303; 206/1.5

[56] References Cited

U.S. PATENT DOCUMENTS

| | | | |
|---|---|---|---|
| 3,393,815 | 7/1968 | Turecek | 215/215 |
| 3,412,886 | 11/1968 | Colella et al. | 215/215 |

*Primary Examiner*—George T. Hall

[57] ABSTRACT

A child proof medication bottle including a female, interiorly threaded opening adapted for dispensing medication in pill form or similar use, provided with a male, externally threaded cap, inserted into the female opening. On insertion, the male cap or plug is received within the opening to a depth wherein only a hemispherical projection is exposed outside the confines of the bottle. This smooth hemispherical projection lacks the necessary grasping surfaces for withdrawal thereof and is thus rendered child proof. The bottom end of the bottle is similarly shaped in the form of a hemisphere adapted for receipt in the interior of the cylindrical key structure provided with a flat end for upright support and including two key elements insertable into corresponding slots formed in the hemispherical surface of the cap. Thus the cylindrical key structure may be utilized to open providing a reminder to the user to return the key to its stored position.

5 Claims, 4 Drawing Figures

FIG. 1
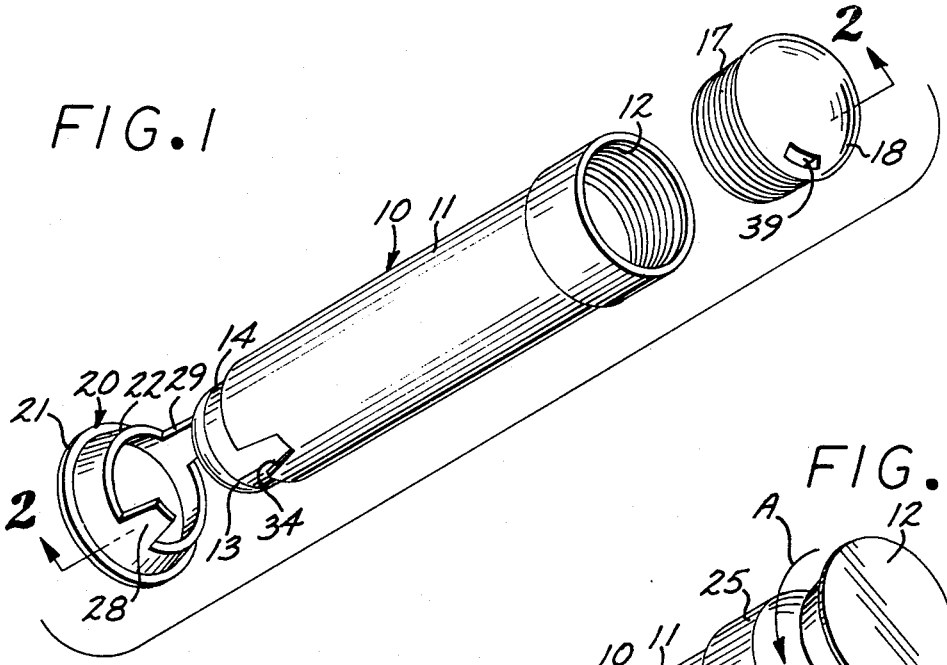
FIG. 3
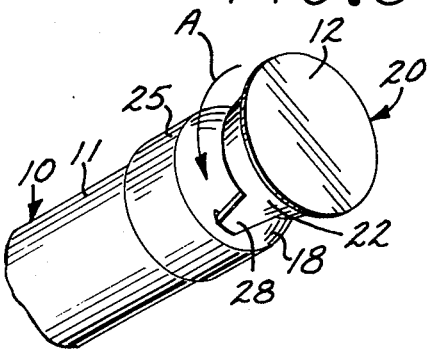
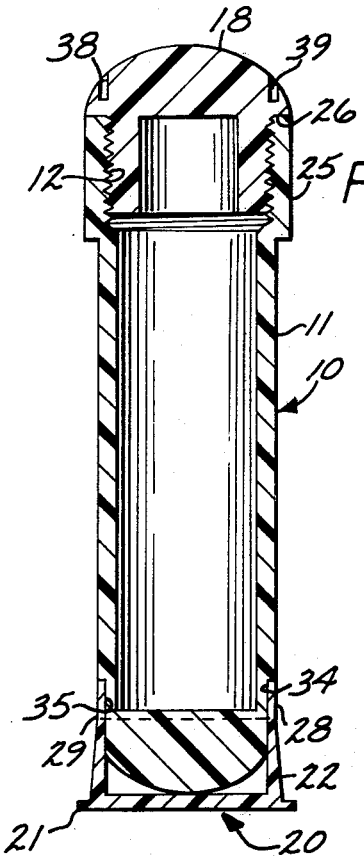
FIG. 2
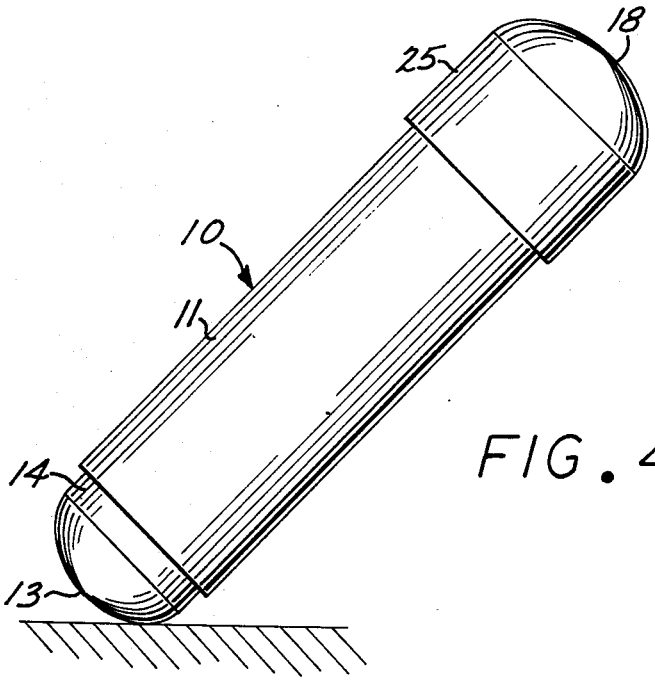
FIG. 4

MEDICATION BOTTLE HAVING A SAFETY CAP

BACKGROUND OF THE INVENTION

1. Field of the Invention

The present invention relates to medicine dispensing containers and more particularly to child proof closures therein.

2. Description of the Prior Art

Child proofing medication containers have been an endeavor of substantial magnitude in the recent past. In view of the number of castastrophic incidence associated with children gaining entry to containers storing dangerous drugs, and particularly in view of the more prevalent availability of substantial drugs in a typical household, the necessity of preventing unauthorized access to such drugs has been considered a matter of paramount recent importance.

For these and other reasons there have been many devices developed in the recent past, some of which comprising various spring biased closures and some others being of a form of a keyed closure, each so formed to render access more difficult to the medication stored in the container. In the first instance, the mechanical complexity of the closure greatly added to the cost of medicine while in the second instance the ease with which proper alignment can be made for opening has significantly reduced the effectiveness thereof. A further feature of the prior art closures has been the convenience with which the closure is reinstalled. Generally it has been the primary intent in most prior art devices to render the opening task more difficult and for that reason detection of unauthorized opening has been less than fully effective. Detection of drug intake is often a desired feature both for the purposes of emergency treatment and for the potential discovery of suicide. The ease with which a closure can be made in the prior art devices effectively masks subsequent investigatin, thus avoiding this desired result.

Thus the closure technique practiced heretofore, having been centrally directed to provide closing convenience, while adequate for child proofing purposes, do not provide the attendant benefits obtainable. It is these added benefits that are expressly addressed in the following disclosure.

SUMMARY OF THE INVENTION

Accordingly it is the general purpose and object of the present invention to provide a child proof closure for a medication bottle which, incidental to this function, also provides indication of incoherent use by an adult.

Futher objects of the invention are to provide a closure for a medication container which is easily achieved through any conventional technique of plastic molding or casting.

Yet further objects of the invention are to provide a closure for a medication bottle which is adapted for cooperation with a key conformed to support the bottle in an upright position.

Yet additional objects of the present invention are to provide a safety closure for a medication container which by virtue by its design requires deliberate and coherent manipulative sequences in the replacement thereof.

Briefly these and other objects are accomplished within the present invention by conforming a medication bottle in the manner of a hollow cylinder, having a lower end formed as a hemisphere and an upper end providing an internally threaded or female opening. Receivable within the internally threaded upper end is a cap or plug, externally threaded over a lower segment thereof, and conformed, once more, to a spherical surface on the upper or exposed end. Included within the spherical surface of the plug are two diametrically opposed key recesses conformed for receipt of two key projections extending from a key assembly shaped as a segment of a cylinder having an interior dimension conformed for receipt of the spherical bottom end of the bottle. The distal or the lower end of the key assembly, furthermore, terminates in a circular support plate and will thus maintain the container or bottle in an upright position when installed.

In the event of unauthorized or incoherent use of the device thus summarized, the key assembly will most often be left either within the key engaging insertion in the plug or completely separate from the bottle. In this instance the unstable base configuration of the bottle will immediately provide the necessary visual index to enable the person rendering aid to quickly identify the drugs taken.

BRIEF DESCRIPTION OF THE DRAWINGS

FIG. 1 is a perspective illustration, in exploded view, of the medication container constructed according to the present invention;

FIG. 2 is a side view, in section, taken along line 2—2 of FIG. 1;

FIG. 3 is a detail view in perspective illustrating the keying engagement of the cooperative parts disclosed herein; and FIG. 4 is a side view of the inventive medication bottle illustrating the instability thereof on incomplete closure.

DESCRIPTION OF THE SPECIFIC EMBODIMENT

While the following disclosure sets out one specific illustration of a medication bottle requiring deliberate manipulative skills both in the opening and closure tasks the results so achieved are not necessarily dependent on the specific geometry. It is therefore to be understood that the following description is illustrative only and no intent to limit the scope of the invention is expressed thereby.

As shown in FIG. 1, a medication container generally designated by the numeral 10 comprises a cylindrical bottle 11 having an enlarged, internally threaded opening 12 at one end thereof and a semispherical bottom surface 13 extending from a reduced diameter segment 14 at the other end thereof. opening 12 is, in turn, conformed to receive an exteriorly threaded plug segment 17 extending from a key, hemispherical cap 18.

Included further in FIG. 1 is key assembly, generally designated by the numeral 20, comprising a circular base plate 21 extending across one end of a cylindrical section 22 conformed on the interior to receive the reduced end segment 14 on the lower end of the bottle 11.

As shown in more detail in FIG. 2, opening 12 is formed on the interior of an enlarged end section 25 with the plug segment 17 joining the cap 18 to form a shoulder 26 adapted to oppose the free end of section 25. Thus by applying the necessary torque to the exterior of the cap a secure closure can be made requiring substantial forces in removal. The smooth hemispherical exterior of cap 18 lacks the necessary tactile or manipulative surfaces for the application of such forces. Accordingly, removal of the cap 18 can only be achieved by way of two key projections 28 and 29 extending from the lateral periphery of the cylindrical section 22 in the key assembly 20 which are, in turn, insertable into two diametrically opposed key slots 38 and 39 formed in the exterior of the cap.

The disposition of the keys 28 and 29 on the key assembly 20 is concurrently accommodated by way of two surface cutouts 34 and 35 on the exterior of the bottle 11. More specifically the cutouts 34 and 35 continue along the surface of the cylindrical reduced section segment 14, extending longitudinally along the exterior surface of the bottle to a dimension conforming to the planar dimension of the corresponding keys. The depth of key assembly 20 furthermore is selected to provide full insertion of the hemispherical bottom end 13 on the interior thereof. Thus the key assembly 20 provides both the necessary flat surface for supporting the bottle in an upright position by way of the disc 21 and furthermore provides the necessary key engagement for withdrawing the cap.

More specifically this insertion of the keys on the key assembly 20 into the key slot 38 and 39 is shown in FIG. 3. As shown in this figure, the normal rotational application of force shown by the arrow A is thus made possible, aiding in the loosening and withdrawal of the cap from the open end of the bottle.

As shown in FIG. 4 unless the key assembly 20 is replaced into its normally stored position around the lower end of bottle 11, the bottle is unstable and will necessarily lie on its edge. This immediately provides a visual clue to any emergency personnel as to what bottle has been potentially used last, thus indicating what kind of drug may have been involved in the emergency.

To simplify production, it is contemplated that the foregoing assembly of parts may be achieved by any plastic casting or molding technique, there being few interfaces requiring high accuracy. Thus the key assembly 20, cap 18, and bottle 11 all may comprise plastic material, transulucent as desired, with the attendant cost advantages thereof.

Obviously many modifications and variations to the above disclosure can be made without departing from the spirit of the invention. It is therefore intended that the scope of the invention be determined solely dependent on the claims hereto.

We claim:

1. A container adapted to store medicine or similar substances, comprising:

a substantially cylindrical enclosure including a first and second end, said first end including an end surface formed thereacross said end surface being conformed in the manner of a first hemispherical structure on the exterior thereof;

an internally threaded segment formed on the interior surface of said second end;

a cap assembly including an exteriorly threaded segment conformed for threaded engagement in said internally threaded segment and a second hemispherical structure of a radius greater than the radius of said exteriorly threaded segment extending therefrom;

a first and second diametrically opposed key slots formed in said second hemispherical structure; and a key assembly including a cylindrical frustum conformed to receive said first hemispherical structure on the interior thereof, a disc attached to one end of said frustum and extending transversely thereacross, and a first and second key member formed on the other end of said frustum and dimensioned for corresponding receipt in said first and second key slot.

2. Apparatus according to claim 1 wherein:

said second end includes a peripheral edge; and said cap assembly includes a peripheral shoulder at the juncture of said exteriorly threaded segment and said second spherical structure, said shoulder being conformed for mating with said peripheral edge.

3. Apparatus according to claim 2 wherein:

said cylindrical enclosure further includes a reduced diameter section at the juncture between said first end thereof and said first hemispherical structure and two diametrically opposed recesses formed in the peripheral surface of said enclosure and conformed to receive said first and second key member concurrent with the receipt of said first hemispherical structure within said frustum.

4. Apparatus according to claim 3 wherein:

said enclosure, cap assembly and key assembly each comprise molded plastic structures.

5. Apparatus according to claim 3 wherein:

said first and second key member each comprises a peripheral element of said frustum; and said first and second key slots are disposed on a diameter equal to said frustum.

* * * * *